United States Patent [19]

Almond

[11] 3,995,477

[45] Dec. 7, 1976

[54] TORQUE SPANNERS

[75] Inventor: Barry Almond, Leicester, England

[73] Assignee: Black & Decker Limited, England

[22] Filed: Feb. 26, 1975

[21] Appl. No.: 553,156

[30] Foreign Application Priority Data

Feb. 26, 1974 United Kingdom ..... 8703/74

[52] U.S. Cl. ..... 73/139; 81/52.5

[51] Int. Cl.[2] ..... B25B 23/14

[58] Field of Search ..... 73/139, 88 F; 81/52.5

[56] References Cited

UNITED STATES PATENTS

| | | | |
|---|---|---|---|
| 3,472,102 | 10/1969 | Dunlap et al. | 73/139 X |
| 3,596,718 | 8/1971 | Fish et al. | 73/136 A X |
| 3,710,874 | 1/1973 | Seccombe et al. | 73/139 X |
| 3,827,506 | 8/1974 | Himmelstein et al. | 81/52.5 X |
| 3,845,657 | 11/1974 | Hall et al. | 73/88.5 R |
| 3,858,444 | 1/1975 | Wallace | 73/139 |
| 3,895,517 | 7/1975 | Otto | 73/139 X |

*Primary Examiner*—Charles A. Ruehl
*Attorney, Agent, or Firm*—Brisebois & Kruger

[57] ABSTRACT

A torque spanner (or other tool for tightening threaded fastenings) which can be carried by the operator in his hand. The spanner incorporates a strain gauge which is arranged to provide an electrical output voltage dependent on the torque applied. An indicating device, operated from the strain gauge, is arranged to indicate to the operator when the torque has reached a prescribed value.

13 Claims, 3 Drawing Figures

TORQUE SPANNERS

This invention relates to a tool for tightening threaded fastenings and in particular to a torque spanner. The term "torque spanner" should hereinafter be taken to mean a tool which an operator can carry in his hand and use in tightening nuts by hand and which is so arranged as to indicate to him when a nut has been tightened up, by use of the tool, to a prescribed torque. It will be realized that the expression "torque spanner" is used herein to include not only tools adapted for tightening nuts but also tools adapted for tightening other threaded fastenings, for example bolts and socket-headed screws.

The design of motor vehicles at the present day frequently calls for the use of alloy castings (for example light alloy cylinder heads) and for the reduction in the amount of metal used in ferrous castings and steel parts. With a light alloy cylinder head it is readily possible, by over-tightening the cylinder head nuts, to distort the cylinder head, whilst, in the case where the amount of ferrous metal used in a part could be said to have been skimped, distortion or damage can result from the over-tightening of nuts. Further, certain nuts may be too inaccessible to allow convenient use of anything other than a socket wrench for tightening them, and the socket wrenches available in garages frequently are such that the same tightening torque can readily be exerted on small nuts as on large nuts, resulting in a tendency to over-tighten small nuts, with the risk that their threads (or the threads they mate with) may be stripped or parts sheared off. In view of the above the use of torque spanners of the type referred to is becoming increasingly common in engineering workshops.

The present invention provides a tool for tightening threaded fastenings which (a) the operator can carry in his hand, (b) incorporates, as part of the tool, a strain gauge arranged to provide an electrical output voltage dependent on the torque applied and (c) comprises an indicating device, operated from the gauge, arranged to indicate to the operator when the torque has reached a prescribed value.

Preferably, the strain gauge forms part of a bridge circuit having an output feeding into an integrated circuit amplifier.

Advantageously, the tool comprises a first integrated circuit amplifier and a second integrated circuit amplifier, the first integrated circuit amplifier being arranged to amplify an electrical output voltage provided by the strain gauge and having an output fed into the second integrated circuit amplifier, and the second integrated circuit amplifier being arranged to compare this output against a preset trip voltage so that the output of the second integrated circuit amplifier will provide an indication, for example, by lighting an LED or by an audible signal, or by a meter reading, as soon as the output of the first integrated circuit amplifier is marginally greater than the preset trip voltage, thereby to indicate to the operator that the torque has reached a prescribed value.

Means may be provided for varying the amount of the preset trip voltage thereby to vary the prescribed value of torque. Preferably, said means comprises a number of resistors in series across a supply voltage to provide a number of distinct points at different voltages, and a switch arranged to select one of these voltages as the trip voltage.

Advantageously, negative feed-back is provided across one of the integrated circuit amplifiers, said negative feed-back being variable in amount to provide different values for the prescribed value of torque.

The tool may be arranged to be powered by an internal battery, for example a rechargeable battery.

Advantageously, the tool is provided by a bar having a socket (or socket-engaging portion) of non-circular (for example square) cross-section, and wherein the strain gauge is mounted on the bar to measure bending moment in the bar. Preferably, the tool has a casing in which the bar is mounted for limited relative movement, and an ON/OFF switch operated by such relative movement on application of torque by the operator.

The tool may take the form of a torque spanner (as hereinbefore defined). Preferably, the torque spanner comprises a device arranged to provide an electrical output voltage dependent on the torque applied, a first integrated circuit amplifier arranged to amplify said voltage, a second integrated circuit amplifier, which latter is arranged to compare this output against a preset trip voltage so that the output of the second integrated circuit amplifier will provide an indication, for example by lighting an LED or by an audible signal or by a meter reading, as soon as the output of the first integrated circuit amplifier is marginally greater than the preset trip voltage, thereby to indicate to the operator that the torque has reached a prescribed value.

A torque spanner constructed in accordance with the invention will now be described by way of example, with reference to the accompanying drawings, in which.

Figure 2:
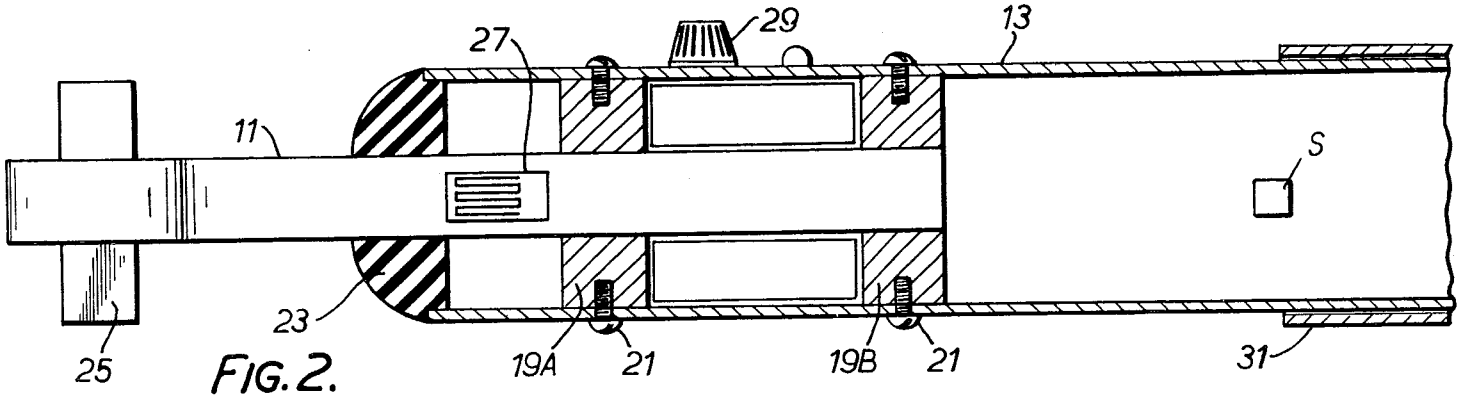
FIG. 2 is a side view of the torque spanner.
Figure 3:
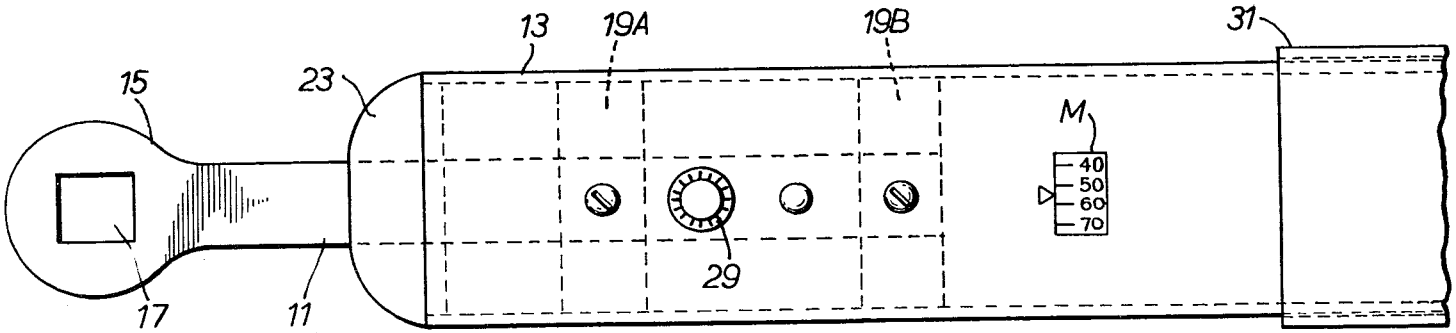
FIG. 3 is a plan view of the torque spanner.

Referring to the drawings, FIGS. 2 and 3 show a torque spanner which comprises a metal bar 11 axially disposed within a cylindrical casing 13. The bar 11 is of square crosssection over the greater part of its length but has a boss 15 at its left hand end in which is formed an aperture 17 which is of square section in plan. The bar 11 is rigidly fixed to two stout metal collars 19A, 19B which are themselves rigidly fixed, by screws, such as 21, to the casing 13 while at 23 is shown a rubber sleeve which fits over the bar 11 and plugs one end of the casing 13.

The aperture 17 is arranged to fit over a vertical bar 25 which forms part of a socket wrench (the rest of which is not shown, but which is of a conventional character), so that when an appropriate socket, at the lower end of the bar 25, is fitted over a nut (for example a cylinder head nut), the nut may be tightened by the operator by swinging the casing 13 clockwise, viewing FIG. 3. The operator will, customarily, steady the upper end of the bar 25 while the nut is tightened.

The illustrative torque spanner incorporates, as part of the tool, a strain gauge 27 arranged to measure the torque applied, the gauge 27 being mounted directly on the bar 11 as shown in FIG. 2.

The gauge 27 forms part of a bridge circuit C (see FIG. 1) having an output which increases as the bending moment applied to the bar increases. The output of the circuit C is fed into an integrated circuit amplifier A1 (for example an integrated circuit amplifier as commercially available under the designation $\mu$A 709, $\mu$A 741, or $\mu$A 777) via leads L1, L2.

The amplifier A1 has an output lead L3 from which negative feed-back is applied (via a selected one of a number of resistors in a variable feed-back unit indicated at FBU) so that the amount of negative feed-back, and so the gain of the amplifier A1, can be set at a number of different values.

The lead L3 feeds the output of the amplifier A1 into an integrated circuit amplifier A2, which may be of the same type as the amplifier A1.

At P is shown a potentiometer having a graduated control knob 29 (FIGS. 2 and 3) to set another input lead, L4, of the amplifier A1 at the present trip voltage.

At LED is a light emitting diode in the output of the amplifier A2, while at M is shown a 0 – 1 milliammeter.

The amplifiers A1, A2 are very small and can conveniently be mounted in the annular space around the bar 11 between the collars 19A, 19B.

The illustrative torque spanner is powered by an internal battery B mounted within the casing 13 to the right of the collar 19B, while the meter M provides an indication both at the top (FIG. 3) and at the side (FIG. 2) of the tool.

At PS is shown a power supply, fed from the battery B and providing a stabilized output at +10v to the circuit C, the potentiometer P, and the amplifiers A1 and A2; a stabilized supply of +2v is also provided which is fed through the meter M to the lead L3.

At S is shown an ON/OFF switch for the battery B. The switch S is operated by a sleeve 31 which loosely surrounds the casing 13 and is held coaxial with the latter by light springs, the arrangement being such that the operator may swing the casing 13 clockwise, to tighten a nut, by pulling on the sleeve 31 and such pulling will displace the sleeve 31 relative to the casing 13 and close the switch S to switch the tool on.

In using the illustrative torque spanner to tighten a nut the operator will first ascertain what torque is prescribed for this nut, which we will assume has its axis vertical, and will adjust the knob 29 of the potentiometer P accordingly. He will also adjust the feed-back unit FBU to set the tool to the required range.

He will then find a socket which will fit the nut, insert the bar 25 into the socket, fit the aperture 17 over the bar 25, and, while steadying the upper end of the bar 25, grasp the sleeve 31 and swing the tool clockwise, viewing FIG. 3. The switch S will thus be closed, and, as the torque on the nut is increased the bending moment applied to the bar 11 will increase and the D.C. output of the circuit C will increase. This D.C. output will be amplified by the amplifier A1 whose output is fed into the amplifier A2. The amplifier A2 acts as a comparator to compare the voltage fed into it from the amplifier A1 against the preset trip voltage it derives from the potentiometer P, and, as soon as the former is marginally greater than the latter the output of the amplifier A2 will rise suddenly and the light emitting diode will light up to provide an indication to the operator that the prescribed torque has been reached. Prior to the light emitting diode lighting up the reading of the meter M will give an indication of how far the torque has increased.

Instead of lighting a light emitting diode the output of the amplifier A2 could be arranged to operate a relay which in turn would cause a bell to ring or a horn to blow to give an audible signal that the prescribed torque has been reached.

Figure 1:
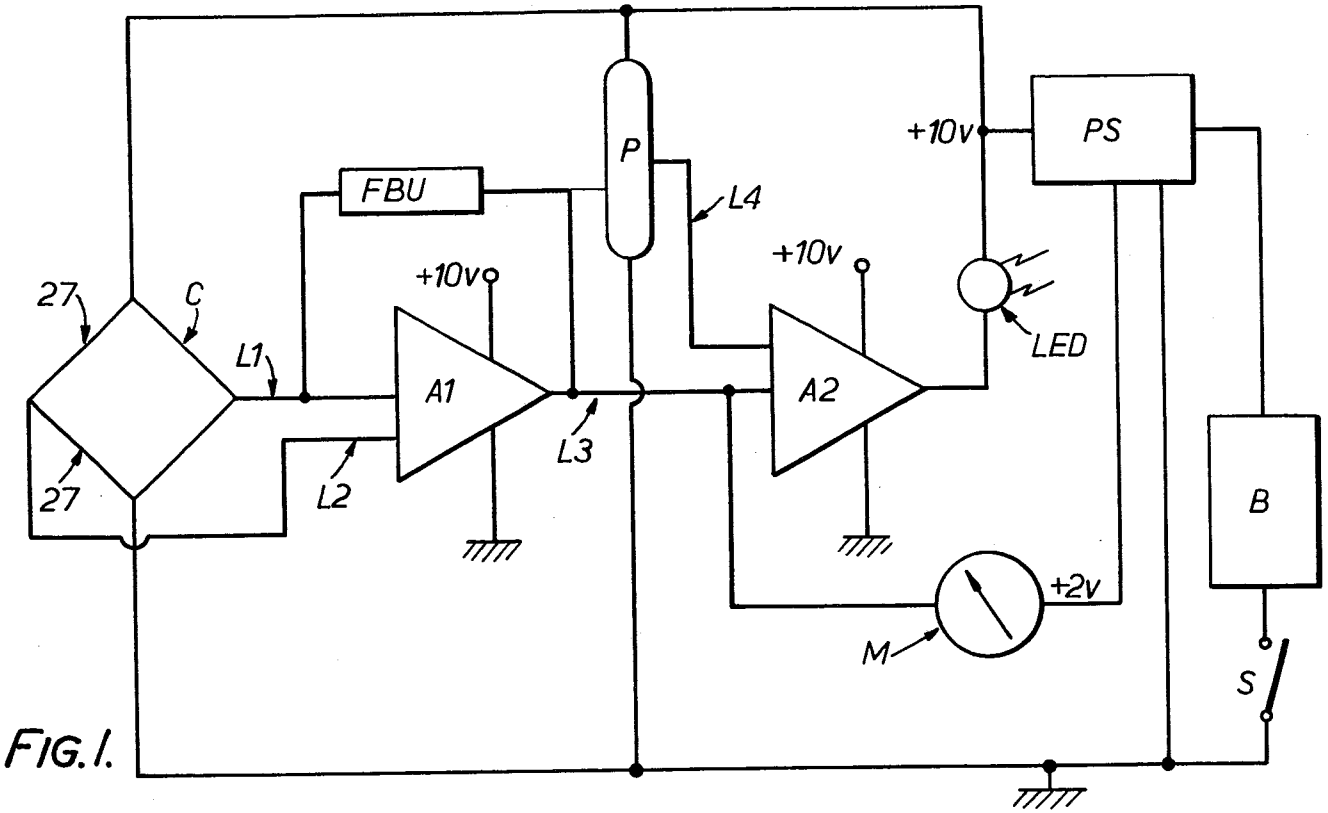
FIG. 1 is a circuit diagram of the torque spanner.

The parts of the illustrative torque spanner which are shown in FIG. 1 are small and robust and the whole tool can readily be carried in one hand.

I claim:

1. A hand-held tool for tightening threaded fastenings, the tool comprising a housing, a bar mounted in said housing for limited movement relative thereto, a strain gauge mounted on said bar to measure bending moment in said bar and so provide an electrical output voltage dependent on the torque applied, an amplifier circuit mounted in said housing, and an indicating device mounted in said housing, said strain gauge forming part of a bridge circuit whose output feeds into said amplifier circuit, wherein said amplifier circuit comprises a first integrated circuit amplifier and a second integrated circuit amplifier, said first integrated circuit amplifier being arranged to amplify said output of said bridge circuit and having an output fed into said second integrated circuit amplifier, and said second integrated circuit amplifier being arranged to compare said output of said first integrated circuit amplifier against a preset trip voltage so that the output of said second integrated circuit amplifier will actuate said indicating device as soon as said output of said first integrated circuit amplifier is marginally greater than said preset trip voltage, thereby to indicate to the operator that the torque has reached a prescribed value.

2. A tool according to claim 1, wherein said indicating device is a light emitting diode.

3. A tool according to claim 1, wherein said indicating device is a relay coupled to a device for emitting an audible signal.

4. A tool according to claim 1, wherein means is provided for varying the amount of said preset trip voltage thereby to vary the prescribed value of torque.

5. A tool according to claim 4, wherein said means comprises a number of resistors in series across a supply voltage to provide a number of distinct points at different voltages, and a switch arranged to select one of these voltages as said trip voltage.

6. A tool according to claim 1, wherein negative feed-back is provided across one of the integrated circuit amplifiers, said negative feed-back being variable in amount to provide different values for the prescribed value of torque.

7. A tool according to claim 1, which is arranged to be powered by a battery mounted in said housing.

8. A tool according to claim 7, wherein said battery is a rechargeable battery.

9. A tool according to claim 1, wherein said bar has a socket of non-circular cross-section extending from said housing.

10. A tool according to claim 9, wherein said socket has a square cross-section.

11. A tool according to claim 9, further comprising an ON/OFF switch operated by said relative movement of said bar on application by torque by the operator.

12. A tool according to claim 1, wherein said indicating device is a milleammeter.

13. A torque spanner comprising a housing, a bar mounted in said housing for limited relative movement, a strain gauge mounted on said bar to measure bending moment, in said bar, said bar having a socket of square cross-section extending from said housing, said strain gauge providing an electrical output voltage dependent upon the torque applied, an amplifier circuit mounted in said housing, an indicating device mounted in said housing, and a battery mounted in said housing, said strain gauge forming part of a bridge circuit whose output feeds into said amplifier circuit, wherein said amplifier circuit comprises a first integrated circuit amplifier and a second integrated circuit amplifier, said first integrated circuit amplifier being arranged to amplify said output of said bridge circuit and having an output fed into said second integrated circuit amplifier, and said second integrated circuit amplifier being arranged to compare said output of said first integrated circuit amplifier against a preset trip voltage so that the output of said second integrated circuit amplifier will actuate said indicating device as soon as said output of said first integrated circuit amplifier is marginally greater than said preset trip voltage, thereby to indicate to the operator that the torque has reached a prescribed value.

* * * * *